US005181624A

United States Patent [19]

Petit

[11] Patent Number: 5,181,624

[45] Date of Patent: Jan. 26, 1993

[54] DEVICE FOR CLOSING FLASKS

[75] Inventor: Robert Petit, Chevilly-Larue, France

[73] Assignee: Lir France (S.A.), Chevilly-Larue, France

[21] Appl. No.: 797,804

[22] Filed: Nov. 19, 1991

[30] Foreign Application Priority Data

Dec. 3, 1990 [FR] France ..... 90 15107

[51] Int. Cl.[5] ..... B65D 55/02; B65D 41/06

[52] U.S. Cl. ..... 215/330; 215/206; 215/211; 215/216; 215/222; 215/223; 215/332; 215/334

[58] Field of Search ..... 215/206, 211, 216, 223, 215/330, 331, 332, 334, 337

[56] References Cited

U.S. PATENT DOCUMENTS

| | | | |
|---|---|---|---|
| 3,422,978 | 1/1969 | Quackenbush | 215/216 |
| 3,581,926 | 6/1971 | Roder | 215/330 |
| 3,747,793 | 7/1973 | Wassilieff | 215/334 X |
| 4,093,096 | 6/1978 | Augros | 215/330 |
| 4,134,513 | 1/1979 | Mumford | 215/216 |
| 4,213,534 | 7/1980 | Montgomery | 215/216 |
| 4,230,232 | 10/1980 | Atkins | 215/330 |
| 4,271,974 | 6/1981 | Quinard | 215/331 |
| 4,280,632 | 7/1981 | Yuhara | 215/331 |
| 4,310,101 | 1/1982 | Sekine | 215/330 |
| 4,351,442 | 9/1982 | Summers | 215/216 |
| 4,375,859 | 3/1983 | Fillmore | 215/223 |
| 4,387,821 | 6/1983 | Geiger | 215/330 |
| 4,410,097 | 10/1983 | Kusz | 215/214 |
| 4,591,063 | 5/1986 | Geiger | 215/330 |
| 4,597,501 | 7/1986 | Gueret | 215/330 |
| 4,605,135 | 8/1986 | Ryder | 215/220 |
| 4,638,918 | 1/1987 | Martínez | 215/295 |
| 4,691,833 | 9/1987 | Ahrens | 215/227 |
| 4,756,435 | 7/1988 | Schick et al. | 215/216 |
| 4,832,220 | 5/1989 | Quennessen | 215/331 |

*Primary Examiner*—Allan N. Shoap
*Assistant Examiner*—Vanessa Caretto
*Attorney, Agent, or Firm*—Young & Thompson

[57] ABSTRACT

A flask is closed by a closing device comprising a closing cap cooperating with the neck of the flask. The device includes two open ramps diametrically opposite provided on the neck of the flask and in the center of which is formed an axially extending projection, the closing cap including a cylindrical skirt formed inside with two diametrically opposite latching studs and each carrying a housing which cooperates with one of the projections.

8 Claims, 1 Drawing Sheet

A
B
1
2
3
4
5
6
7
8
9
10
11
12
13
14

DEVICE FOR CLOSING FLASKS

TECHNICAL FIELD

The invention relates to a device for closing a flask of the type including a closing cap cooperating with the neck of the flask, particularly for perfumery and cosmetology.

Usually, the closing caps or plugs include an inner thread cooperating with a thread formed on the neck of the flask or on a receiving ring fixed on this neck. This traditional closing system allows the opening only in one direction of rotation of the cap and the closing in the other direction of rotation of the cap.

Moreover, the closing pressure, which ensures for the tightness via interposed seals, is provided only by the degree of screwing of the cap. Consequently, it is frequent to screw too tightly the cap, with the risk of damaging and/or excessively compressing the seals. It also happens that the screwing is insufficient, so that the tightness is not ensured and/or the cap has a tendency to be unscrewed.

Moreover, another disadvantage of this traditional system is that it does not ensure an accurate and repetitive positioning of the cap when closed, which impairs the aesthetics appearance of the flask when, for example, the cap has a geometrical shape complementary to that of the flask as such.

DISCLOSURE OF THE INVENTION

The object of the present invention is to provide a new device for closing flasks which does not present the disadvantages of the known systems just described.

To this effect, the closing device according to the invention is characterized in that it includes two open ramps diametrically opposite provided on the neck of the flask and in the centre of each of which is formed an axially extending projection, the closing cap including a cylindrical skirt formed inside with two latching studs diametrically opposite and each carrying a housing which cooperates with one of said projection.

The guiding of the cap is provided by its cylindrical skirt cooperating with the neck of the flask and by the latching studs cooperating with one or the other of the neck ramps, according to the direction of rotation of the cap. An accurate positioning of the cap, in the latched position, is provided by the cooperation of the projection with the housing separating the latching studs. The latching and unlatching operations are ensured by the rotation over a quarter of a turn of the closing cap, in one direction of rotation or the other, with respect to the openings of the ramps.

Advantageously, the closing cap includes an outer body connected to said cylindrical skirt by a flexible ring, so as to apply said outer body against the shoulder of the flask when in the latched position.

According to an embodiment, the ramps and their projections are formed directly on the flask neck, made of glass or a synthetic material. As an alternative, the ramps and their projections are formed on a ring fixed on the flask neck.

According to an embodiment of the invention, the cylindrical skirt is closed by an upper end wall which is provided with a self-jointing sealing plug placed in the center of said wall and protruding toward the flask. Thus, there is obtained a reliable tightness of the flask after latching, without having to use attached seals which can be omitted during the assembly or lost when the flask is being used.

Advantageously, the cylindrical skirt with its latching studs and its self-jointing sealing plug is of a single piece with the outer body and the flexible connecting ring.

Preferably, the closing cap has a geometrical shape which is complementary to that of the flask, at least in the latched position.

BRIEF DESCRIPTION OF DRAWINGS

The invention will be better understood from the reading of the following description which is made with reference to the accompanying drawings wherein.

BEST MODE OF CARRYING OUT THE INVENTION

Figures 1, 2, 3, 4, 5, 6:
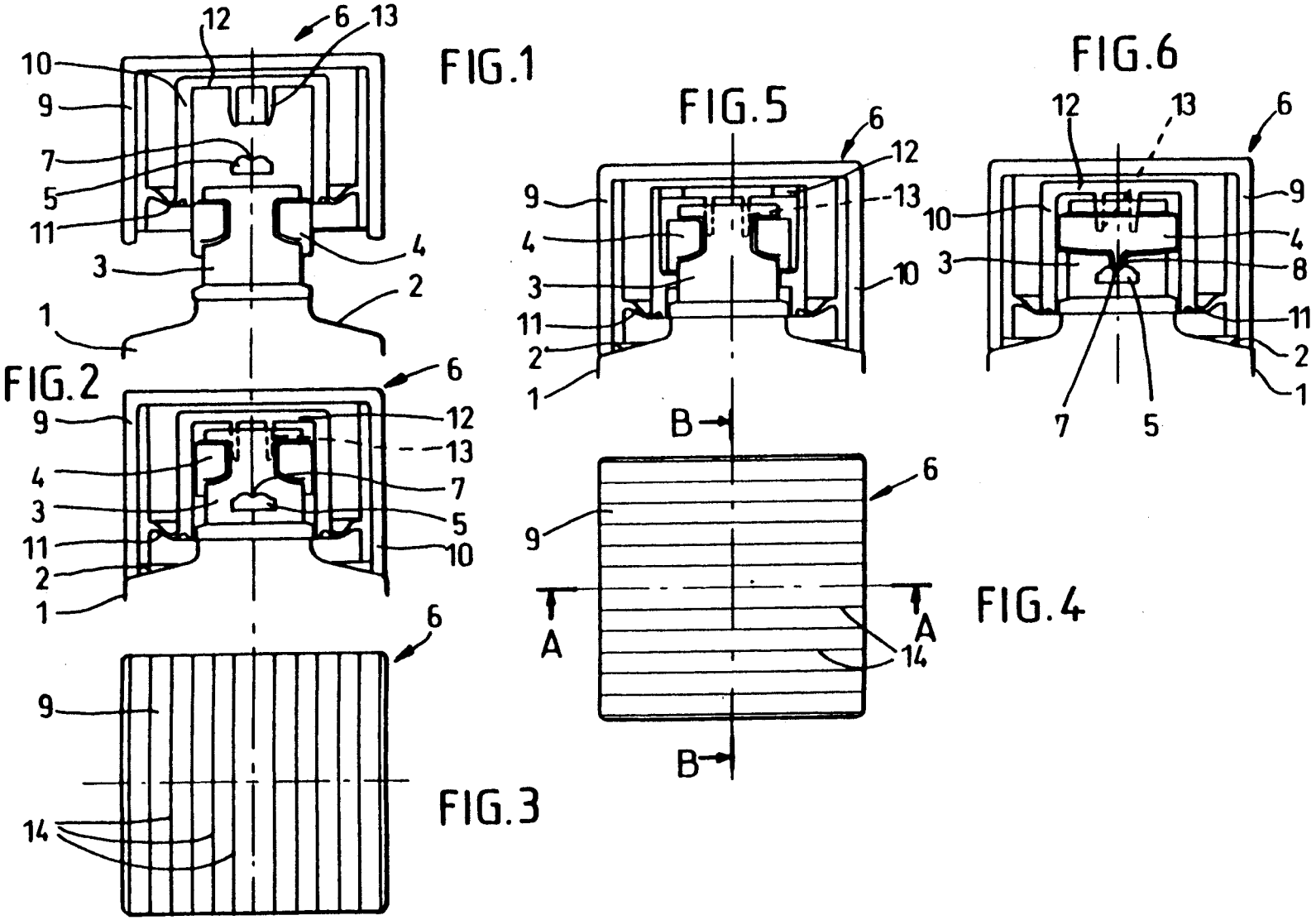
FIG. 1 is a schematic axial sectional view of a closing device according to an embodiment of the invention, prior to the driving in of the cap on the flask neck.
FIG. 2 is similar to FIG. 1, once the cap has been driven in on the flask neck.
FIG. 3 is a top view of the cap, for the positions of FIGS. 1 and 2.
FIG. 4 is similar to FIG. 3, after rotation and latching of the cap.
FIGS. 5 and 6 are axial sectional views respectively along lines A—A and B—B of FIG. 4.

The device according to the invention is intended for closing a flask 1 the neck of which, which is connected to the flask body by a shoulder 2, carries a receiving ring 3. The ring 3 carries two open ramps 4 leaving between themselves at each of their ends a passage for a latching stud 5 of a latching cap 6. Each stud 5 is provided with a central housing 7 (FIG. 6). Each ramp 4 is formed in its center with an axially extending projection 8.

The latching cap 6 is made of an outer body 9, of square transverse section in the example shown, connected to an inner cylindrical skirt 10 by a flexible ring 11. The latching studs 5 with their housings 7 are formed on the inner wall of skirt 10. The skirt 10 is closed at its upper end by a wall 12 forming a self-jointing sealing plug 13 placed in its center and facing the flask 1.

The ramps 4, with their projections 8, instead of being formed on the ring 3, can be provided directly on the flask neck 1 which can be made of glass or a plastic material.

The operation of the closing device according to the invention is as follows:

Starting from the position of FIG. 1, the studs 5 being in register with the passages between the ends of ramps 4, the closing cap 6 is driven in so as to reach the position of FIG. 2. This starting position is easily identifiable by the user by the shape of the outer body 9 and/or by a mark, for example lines 14 formed on the upper face of body 9. The plug 13 is driven in the neck of flask 1 and the lower edge of the outer body 9 is applied against shoulder 2 of flask 1, due to the deformability of the flexible ring 11. The flask is closed but the cap 6 is not latched.

The user imparts then to the cap 6 a rotation over 90° in one direction or the other so as to reach the positions of FIGS. 4 to 6 in which cap 6 is latched on flask 1. The projections 8 of ramps 4 have snapped-in resiliently respectively in a housing 7 of a stud 5, thereby providing a latching with an accurate positioning of cap 6.

This allows providing cap 6 with a shape which is complementary to that of flask 1, other than a shape of revolution, which ensures perfect aesthetics of the latched flask. If, as in the example shown, the outer body 9 has a square transverse section, or any other polygonal shape, these aesthetics are preserved in the unlatched closed position, this position being shown by the direction of lines 14.

I claim:

1. A device for closing a flask having a neck with a closing cap cooperating with said neck, said device comprising two diametrically opposed open ramps separated by passages therebetween and provided on the neck of the flask, each ramp having in its center an axially extending projection, said closing cap including a cylindrical skirt formed inside with two latching studs diametrically opposite and each carrying a housing which cooperates with one of said projections, said flask being closable by axially downwardly driving said closing cap in the same direction as said projections when the latching studs are in register with the passages between the ramps, said cap being rotatable in either direction of rotation to secure either projection with either housing.

2. A closing device according to claim 1, wherein said flask includes a shoulder, and the closing cap comprises an outer body connected to said cylindrical skirt by a flexible ring so as to apply said outer body against a shoulder of the flask in a latched position.

3. A closing device according to claim 1, wherein the ramps and their projections are formed directly on the neck of the flask, and said flask is of a material selected from the group consisting of glass and synthetic material.

4. A closing device according to claim 1, wherein the ramps and their projections are formed on a receiving ring fixed to the neck of the flask.

5. A closing device according to claim 1, wherein the cylindrical skirt is closed by an upper end wall which is provided with a self-jointing sealing plug placed in the center of said wall and protruding toward the flask.

6. A closing device according to claim 5, wherein the closing cap further comprises an outer body connected to said cylindrical skirt by a flexible ring, and the cylindrical skirt with its latching studs and its self-jointing sealing plug is of a single piece with the outer body and the flexible ring.

7. A closing device according to claim 1, wherein the closing cap has a geometrical shape which is complementary to that of the flask, at least in a latched position.

8. A closing device according to claim 1, wherein the closing cap includes an upper face having an orientation mark thereon.

* * * * *